US009555428B2

(12) United States Patent
Santagiuliana

(10) Patent No.: US 9,555,428 B2
(45) Date of Patent: Jan. 31, 2017

(54) DEVICE FOR DISPENSING FLUIDS OR MIXTURES

(75) Inventor: Evans Santagiuliana, Vicenza (IT)

(73) Assignee: Taplast S.P.A., Dueville-Povolaro (IT)

( * ) Notice: Subject to any disclaimer, the term of this patent is extended or adjusted under 35 U.S.C. 154(b) by 0 days.

(21) Appl. No.: 13/985,681

(22) PCT Filed: Feb. 13, 2012

(86) PCT No.: PCT/IB2012/000263

§ 371 (c)(1),
(2), (4) Date: Aug. 15, 2013

(87) PCT Pub. No.: WO2012/114174

PCT Pub. Date: Aug. 30, 2012

(65) Prior Publication Data

US 2013/0320042 A1 Dec. 5, 2013

(30) Foreign Application Priority Data

Feb. 22, 2011 (IT) ..... VU2011A0034

(51) Int. Cl.
*B65D 37/00* (2006.01)
*B05B 11/00* (2006.01)

(52) U.S. Cl.
CPC ..... *B05B 11/3029* (2013.01); *B05B 11/303* (2013.01); *B05B 11/3047* (2013.01)

(58) Field of Classification Search
CPC ..... B05B 11/3028; B05B 11/3029; B05B 11/303; B05B 11/3035; B05B 11/3047; A47K 5/1208; B67D 1/0425
USPC .... 222/153.13, 207, 209, 231, 383.1, 481.5, 222/321.8
See application file for complete search history.

(56) References Cited

U.S. PATENT DOCUMENTS

| | | | | | |
|---|---|---|---|---|---|
| 3,726,442 | A | * | 4/1973 | Davidson et al. | 222/207 |
| 3,869,089 | A | * | 3/1975 | Karasa et al. | 239/338 |
| 3,910,458 | A | * | 10/1975 | Ewald | 222/41 |
| 4,565,306 | A | | 1/1986 | Nakanishi et al. | 222/383 |
| 4,962,870 | A | * | 10/1990 | Schneider | B05B 11/3028 222/207 |
| 5,224,627 | A | | 7/1993 | Weag | 222/135 |
| 5,887,760 | A | * | 3/1999 | Johnson | B67D 1/0425 222/209 |
| 5,971,209 | A | * | 10/1999 | Bayless | B67D 1/0425 222/135 |

(Continued)

FOREIGN PATENT DOCUMENTS

| | | | |
|---|---|---|---|
| CN | 1802220 | 10/2010 | B05B 11/00 |
| JP | 63-161152 | 10/1988 | B65D 35/26 |
| WO | WO 2004/080607 | 9/2004 | B05B 11/00 |

*Primary Examiner* — Frederick C Nicolas
*Assistant Examiner* — Bob Zadeh
(74) *Attorney, Agent, or Firm* — Fattibene and Fattibene LLP; Paul A. Fattibene

(57) ABSTRACT

The present invention concerns a device (1; 51) for dispensing a fluid (L), having a supporting structure (2) provided with means (3) for coupling to a container (C) containing the fluid (L) and a collapsible chamber (6) associated with the supporting structure (2) and suited to draw and contain a measured quantity of the fluid (L). Said device comprises lever operating means (16) suited to deform the collapsible chamber (6) in order to dispense a portion of the measured quantity. The invention also implements a system for dispensing a fluid (L).

16 Claims, 6 Drawing Sheets

(56) References Cited

U.S. PATENT DOCUMENTS

| | | | | |
|---|---|---|---|---|
| 6,026,979 | A * | 2/2000 | Huang | A47J 41/0033 220/23.91 |
| 6,119,900 | A * | 9/2000 | Iwamoto | A47J 41/0033 222/153.13 |
| 6,619,512 | B1 * | 9/2003 | Sayers | A47K 5/1207 222/181.3 |
| 7,775,461 | B2 * | 8/2010 | Laidler | B05B 11/0027 239/323 |
| 7,975,881 | B1 * | 7/2011 | Glucksman | B67D 1/0425 221/150 R |
| 8,459,510 | B2 * | 6/2013 | Richards | B65D 47/249 222/188 |
| 8,991,648 | B2 * | 3/2015 | Smith | A47K 5/1208 222/1 |
| 2008/0078781 | A1 * | 4/2008 | Py | B65D 75/5866 222/96 |
| 2010/0140299 | A1 * | 6/2010 | Sweeton et al. | 222/207 |
| 2010/0219207 | A1 | 9/2010 | Canfield | 222/207 |
| 2013/0320042 | A1 * | 12/2013 | Santagiuliana | B05B 11/3029 222/207 |

* cited by examiner

DEVICE FOR DISPENSING FLUIDS OR MIXTURES

TECHNICAL FIELD OF THE INVENTION

The present invention concerns the technical field of systems for dispensing fluids or mixtures.

In particular, the present invention concerns a device for dispensing a fluid, suited to be applied to a container containing said fluid, particularly suited to dispense food substances, perfumes or detergents in general.

DESCRIPTION OF THE STATE OF THE ART

It is known that in the sector of dispensing devices for liquid or creamy products, like food substances, soaps, creams, detergents or perfumes, dispensing devices with collapsible chamber are used, which are applied to the container of the above mentioned products.

Said devices substantially comprise a supporting structure provided with means for coupling to the neck of the container and a unit suited to dispense the fluid contained in the container and consisting of a collapsible chamber suited to draw and contain a measured quantity of the fluid coming from the container and to dispense a portion of said measured quantity.

The fluid is drawn into the collapsible chamber and dispensed by the user who performs a manual operation, first compressing and then releasing the collapsible chamber directly with one or more fingers. During the compression stage the fluid contained in the collapsible chamber is dispensed towards the external environment through a suitable outlet duct. In the successive release stage the collapsible chamber automatically returns in the non compressed position, drawing into the chamber a measured quantity of fluid, which will remain therein, ready for the successive dispensing operation.

A first drawback posed by said dispensing devices lies in that the quantity of fluid that is dispensed each time the user operates the device is not always the same. Said quantity, in fact, depends on how the collapsible chamber is compressed and therefore on the extent and direction of the force exerted by the user's fingers, which will be different from time to time. The extent and direction of the force depends, furthermore, on the size of the fingers.

Another drawback posed by said devices lies in that the parts that make them up, in particular the collapsible chamber, are subjected to non uniform wear. Said wear, in fact, essentially depends on the intensity and direction of the force exerted by the user who, as explained above, is different from time to time.

Thus, it is not possible to define in advance what area is more subjected to wear, and therefore the device must be designed so as to be oversized, in order to guarantee the desired useful life for all of its parts.

A further drawback of said devices is represented by the fact that the material of which the collapsible chamber is made must be elastic on one hand, so as to be able to perform its drawing function when it is released after compression, and on the other hand it must have rigidity properties that allow it to resist the continuous compression operations performed by the user. Said rigidity involves the need for the user to exert a rather high compression force, which in some cases can be a drawback, for example for users who can exert less force with their fingers, like children or elderly people.

A further drawback posed by said devices lies in that the material of which the collapsible chamber is made must be sufficiently rigid to resist possible chemical attacks that may modify its elasticity characteristics. Said rigidity involves the need for the user to exert a rather high compression force, which in some cases can be a drawback, as explained above, for example for users who can exert less force with their fingers, like children or elderly people.

The object of the present invention is to overcome the drawbacks described above.

In particular, it is a first object of the invention to provide a device with collapsible chamber for dispensing a fluid that makes it possible to control the quantity of fluid that is dispensed every time it is operated.

It is a further object of the invention to provide a device with collapsible chamber for dispensing a fluid that is less subjected to wear than the devices of known type.

It is a further object of the invention to provide a device with collapsible chamber for dispensing a fluid that makes it possible to reduce and/or control the operating force necessary for the user to dispense the fluid.

SUMMARY OF THE PRESENT INVENTION

The present invention is based on the general consideration that it is desirable to provide a device for dispensing a fluid for a container containing said fluid and suited to be operated through lever operating means.

According to a first embodiment, the object of the present invention is a device according to claim 1, that is, a device for dispensing fluids comprising a supporting structure provided with means for coupling to a container of said fluid and a collapsible chamber associated with said supporting structure and suited to draw and contain a measured quantity of said fluid, said device comprising lever operating means suited to deform said collapsible chamber in order to dispense at least one portion of said measured quantity.

Preferably, the lever operating means comprise a second order lever whose fulcrum is associated with the supporting structure.

According to a first preferred embodiment, the lever operating means are made in a single piece with the supporting structure.

The device according to the invention preferably comprises positioning means suited to define an active position of the lever operating means in order to allow the collapsible chamber to be deformed and the lever operating means to be placed in an inactive position.

Said positioning means suitably comprise an elastic area of the lever operating means.

Advantageously, the elastic area, the supporting structure and the lever operating means are carried out in a single piece.

According to another embodiment of the invention, the elastic area, the supporting structure and the operating means are constituted by separate elements that are properly assembled together.

The lever operating means preferably comprise a shaped area whose shape matches the shape of the area of the collapsible chamber with which they come into contact.

Advantageously, the device according to the invention may comprise adjustable end-of-stroke means for the lever operating means.

According to one of its preferred embodiments, the collapsible chamber comprises an elastically yielding ball portion associated with the supporting structure.

The ball portion preferably comprises a hemispherical portion.

According to a preferred embodiment of the invention, the collapsible chamber comprises an elastically yielding portion provided with one or more ribs.

In another preferred embodiment of the invention, the collapsible chamber comprises an elastically yielding portion having a substantially plane area provided with corrugations.

The collapsible chamber of the device preferably communicates with the container through a suction duct.

The device preferably comprises valve suction means suited to regulate the flow of the fluid from the suction duct into the collapsible chamber.

Even more preferably, said valve means comprise a ball for selectively opening and closing the suction duct.

The collapsible chamber of the device preferably communicates with the outside through a dispensing duct.

Dispensing valve means are properly provided that are suited to regulate the fluid dispensing operation from the collapsible chamber to the dispensing duct.

According to a preferred embodiment, the coupling means allow the device to be removably coupled to the container.

The coupling means preferably comprise a threaded area.

According to a second aspect of the present invention, its subject is a system for dispensing a fluid carried out according to claim 15, meaning a system for dispensing a fluid comprising a container for said fluid and a device for dispensing said fluid carried out according to the description provided above.

BRIEF DESCRIPTION OF THE DRAWINGS

Further advantages, objects and characteristics, as well as further embodiments of the present invention are defined in the claims and will be illustrated in the following description, with reference to the enclosed drawings; in the drawings, corresponding or equivalent characteristics and/or components are identified by the same reference numbers. In particular:

DETAILED DESCRIPTION OF THE PRESENT INVENTION

The examples of embodiment of the invention described below refer to devices for dispensing detergent products. It is clear that the solution proposed can be applied also to devices for dispensing perfumes or food products, or any other fluid in general, drawn from a container and conveyed towards the outside.

Figure 1:
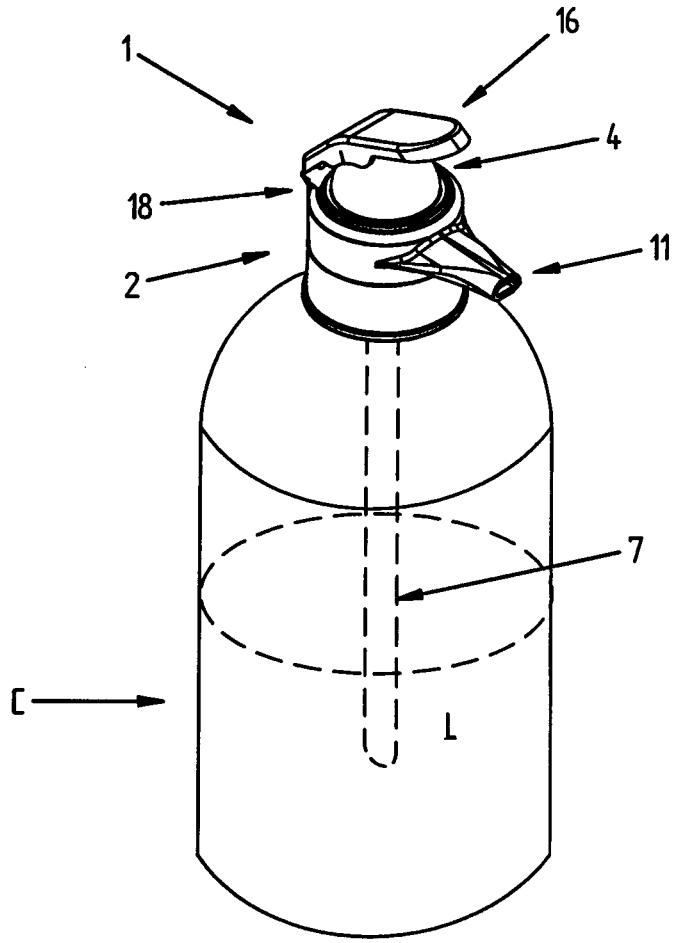
FIG. 1 shows a first embodiment of the dispensing device of the invention applied to a container.

An example of embodiment of a device for dispensing fluids, which is the subject of the present invention, applied to a container C of a fluid L to be dispensed, is shown in FIG. 1, where it is indicated as a whole by 1.

It comprises a supporting structure 2 provided with means 3 for coupling to the container C. Said coupling means 3 are constituted by a threaded portion, visible in FIG. 4, suited to be engaged with a corresponding threaded portion, not shown in the figures, present on the neck of the container C.

In variant embodiments of the invention, said coupling means may be of a different type, for example they may be of the snap coupling type.

A hemispherical element 4 is associated with the top of the supporting structure 2. The element 4 is elastically yielding and thus deformable.

Figure 6:
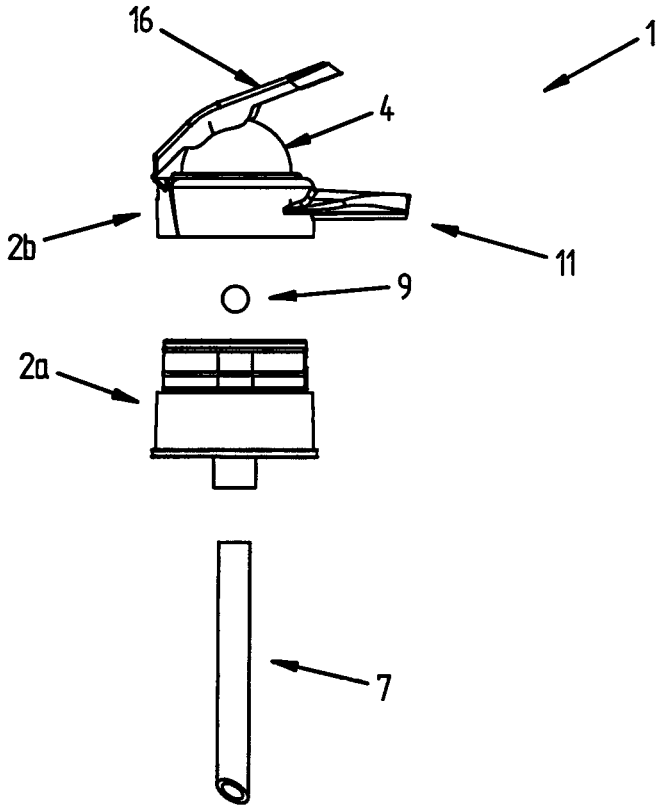
FIG. 6 shows an exploded side view of the device shown in FIG. 2.

The supporting element 2 is carried out in two parts, a bottom part 2*a* and a top part 2*b*, suited to be associated with each other with a snap coupling action and better visible in FIG. 6.

The deformable element 4 is associated with the top part 2*b* of said supporting structure 2.

Figure 4:
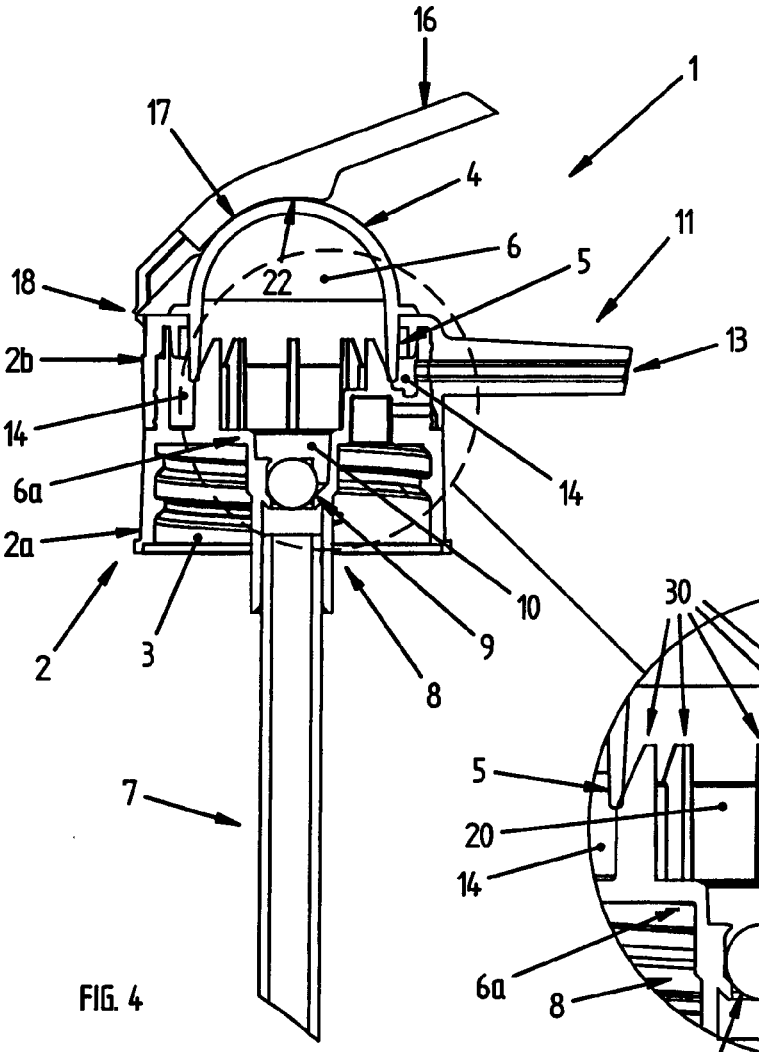
FIG. 4 shows a sectional view of FIG. 3 along line IV-IV.
Figure 4A:
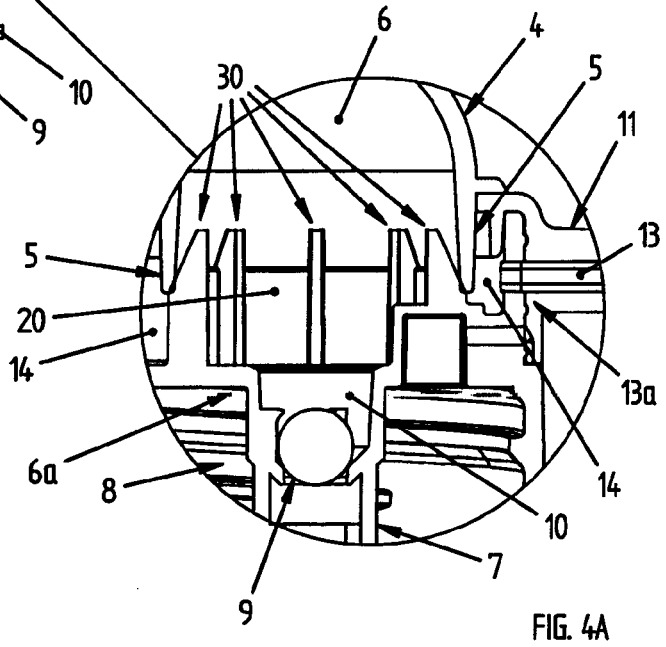
FIG. 4A shows an enlarged detail of FIG. 4.

The deformable element 4 is provided with a lower annular edge 5, which is elastically yielding, too, as will be better explained below, and is arranged so that it rests against the outside of truncated cone-shaped ends of ribs 30 of a first substantially cylindrical portion 20 defined in the bottom part 2*a* of the supporting structure 2, as shown in FIG. 4A.

A chamber 6 suited to contain a quantity of liquid L to be dispensed is defined between the deformable element 4 and the supporting structure 2.

A suction pipe 7 develops from the lower portion 6*a* of the chamber 6, said pipe having a predetermined length, such that the pipe can be arranged substantially in proximity to the bottom of the container C, as can be seen in FIG. 1.

At the level of the lower portion 6*a* of the chamber 6 there are first valve means 8 arranged between the chamber 6 and the suction pipe 7 and suited to regulate the flow of the fluid L in the chamber 6.

Said first valve means 8 are constituted by a ball 9 whose diameter is longer than the inner diameter of the suction pipe 7, accommodated in a housing portion 10 obtained in the bottom part 2*a* of the supporting structure 2. Inside said housing portion 10 the ball 9 can be arranged in different positions in order to allow the suction pipe 7 to be selectively opened and closed during operation of the device 1, as will be better explained in the description provided below.

On the side wall of the top part 2*b* of the supporting structure 2 there is an outlet nozzle 11 comprising a duct 13 for dispensing the fluid L towards the outside of the device 1, and thus towards the outside of the container C.

The inner end 13*a* of the duct 13 communicates with an annular chamber 14 defined between the top part 2*b* and the bottom part 2*a* of the supporting structure 2 and the external surface of the lower annular edge 5 of the deformable element 4.

On the upper edge 15 of the top part 2*b* of the supporting structure 2 there is an operating lever 16 suited to be arranged in contact with the external upper surface 17 of the deformable element 4.

The operating lever 16 is preferably carried out in a single piece together with the top part 2*b* of the supporting structure 2 and is provided with an elastic fulcrum portion 18 provided with an opening 19 suited to allow the rotation of the lever 16 itself.

Figure 5:
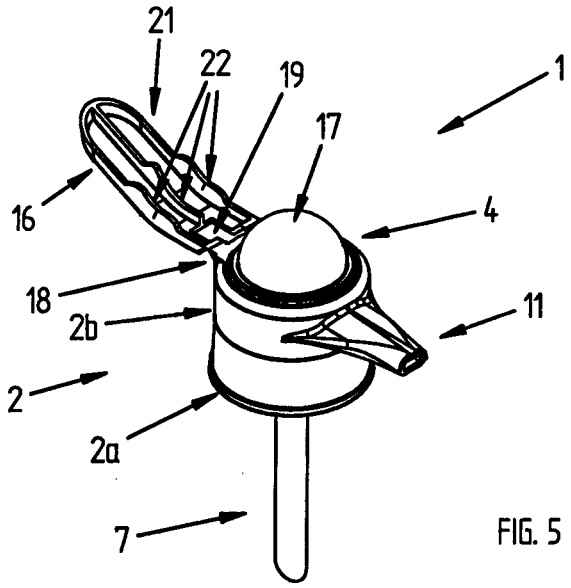
FIG. 5 shows the device shown in FIG. 2 in a different operating mode.

On the surface 21 of the lever 16 facing the deformable element 4, in its operating condition shown for example in FIG. 4, there are three ribs 22 in the shape of an arc of a circle, suited to match the spherical shape of the external upper surface 17 of the deformable element 4, better visible in FIG. 5.

According to variant embodiments of the invention, the surface 21 may have a different shape, so that it effectively matches the spherical shape of the external upper surface 17 of the deformable element 4, like for example a hemispherical convex shape.

Figure 2:
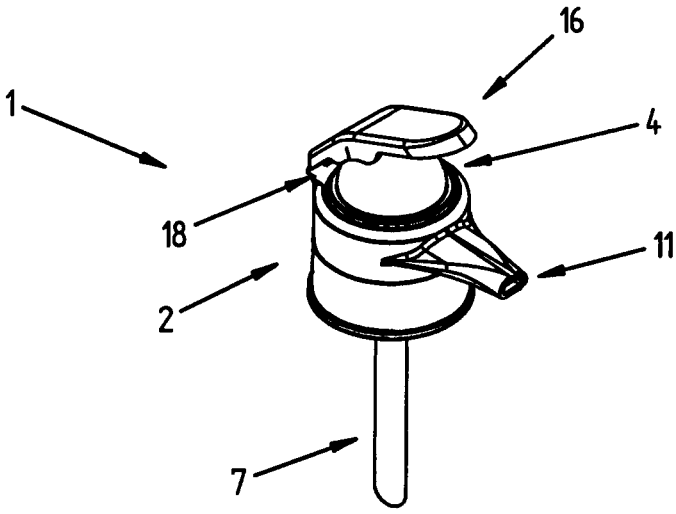
FIG. 2 shows an axonometric view of the device of the invention shown in FIG. 1.
Figure 3:
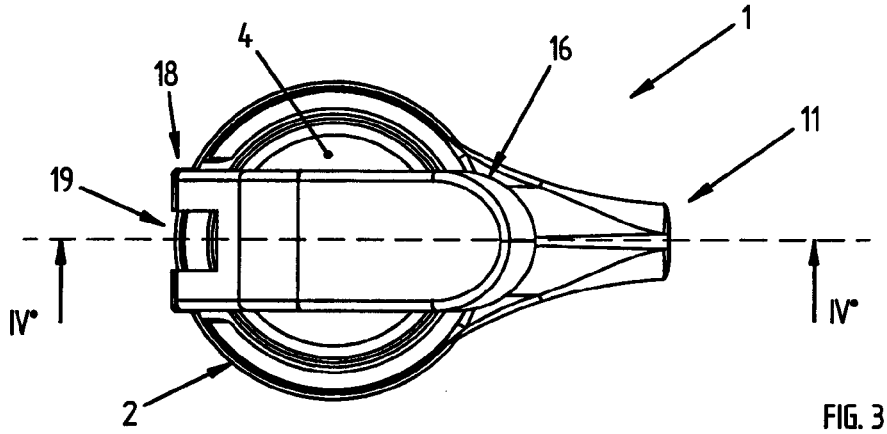
FIG. 3 shows a plan view of the device shown in FIG. 2.

The lever 16 can rotate around the fulcrum portion 18 and from the operating position, shown for example in FIG. 2, it can rotate and reach the rest position, as shown in FIG. 5.

Advantageously, said rest position can be maintained thanks to the elasticity and the particular configuration of the fulcrum portion 18.

As already explained, the top part 2*b* of the supporting structure 2 and the operating lever 16 are preferably carried out in a single piece and therefore can advantageously be obtained by means of a plastic moulding operation.

According to construction variants of the invention, however, the operating lever 16 may be a separate piece removably associated with the supporting structure 2, for example by means of a hinge element.

In this case, an elastic element can advantageously be interposed between the operating lever and the supporting structure, for example a helical spring with one end connected to the operating lever and the other end connected to the supporting structure.

Therefore, in this variant embodiment the operating lever, the supporting structure and the elastic element are constituted by three separate elements properly assembled together.

In other variant embodiments, furthermore, the position of the operating lever fulcrum can be different, so as to properly adapt to the size of the supporting element and/or the deformable element.

The operating stages of the device 1 of the invention are described below with reference to FIGS. 7 to 11.

For the sake of simplicity, said stages are described with reference to the device 1 without the container C, but it is evident that said stages refer to the operation of the device 1 applied to the container C for dispensing doses of the fluid L contained therein.

Figure 7:
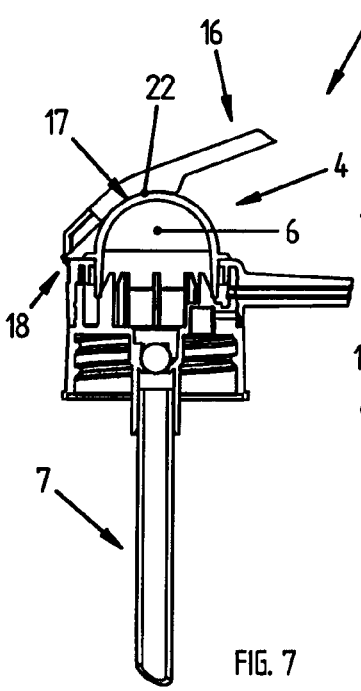
FIGS. 7 to 11 show the operating stages of the device shown in FIG. 2.

In FIG. 7 the device 1 is in rest condition, ready for use, with the operating lever 16 resting on the deformable element 4.

In particular, the ribs 22 of the lever 16 rest on the external upper surface 17 of the deformable element 4.

The description of the stages will start from the rest condition shown in FIG. 7, assuming that the fluid L is already present inside the chamber 6, this being the operating condition that occurs during normal use of the device 1, except when this is used for the first time.

Figure 8:
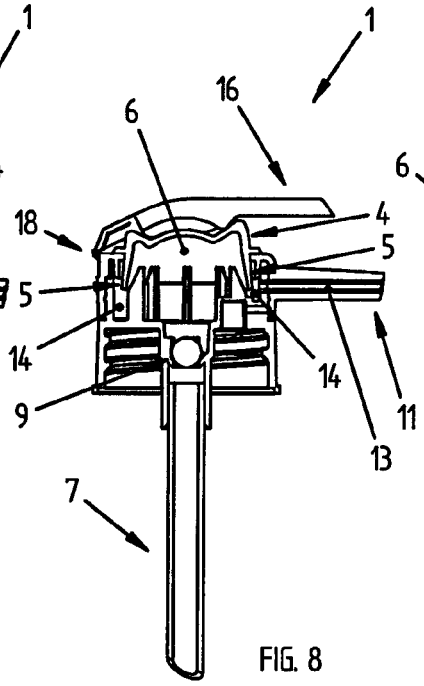

FIG. 8 shows the first operating stage of the device 1, in which the lever 16 is operated by rotating it around the fulcrum 18 and exerts a thrusting action on the deformable element 4.

The thrusting action on the deformable element 4 increases pressure inside the chamber 6 and the lower annular edge 5 of the deformable element 4 undergoes a lateral deformation towards the outside, creating an opening towards the annular chamber 14.

Figure 9:
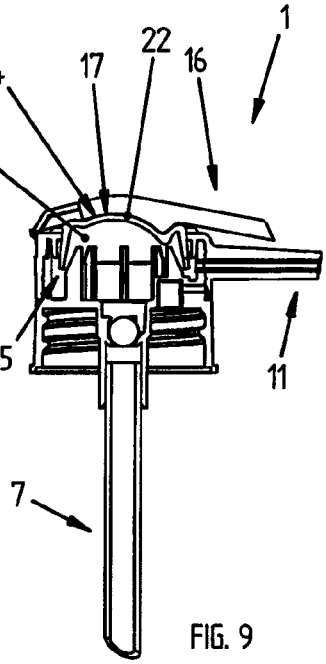

During said stage the ball 9 obstructs the suction pipe 7, so that the fluid L is compressed and thrust from the inside of the chamber 6 only towards the annular chamber 14. From here, it is expelled towards the outside by compression, through the duct 13 of the outlet nozzle 11. This situation continues as long as the operating lever 16 is rotated and compresses the deformable chamber 4 and as long as the lever 16 reaches its end-of-stroke position, as shown in FIG. 9.

During said compression stage, the deformable element 4, and in particular its external upper surface 17, is compressed in an optimal manner by the ribs 22 of the lever 16, thanks to their circular conjugated shape.

At the end of the compression stage a predetermined quantity of fluid L will be dispensed from the chamber 6 towards the outside.

Said predetermined quantity depends on the extent of deformation to which the deformable element 4 is subjected and therefore on the extent of volume reduction of the chamber 6.

Advantageously, said predetermined quantity of fluid L to be dispensed can therefore be defined by intervening on the extent of the maximum stroke of the lever 16 around the fulcrum 18. For this purpose it will be possible to provide more or less extended stop areas serving as end of stroke for the lever 16 in order to determine corresponding more or less extended maximum rotation angles for the lever 16 itself.

Once the stage of dispensing the fluid L has been completed, the release stage of the lever 16 starts, coinciding with the stage in which the fluid L is drawn from the container C in order to restore the quantity of fluid L inside the chamber 6 to be used for the successive dispensing operation.

Figure 10:
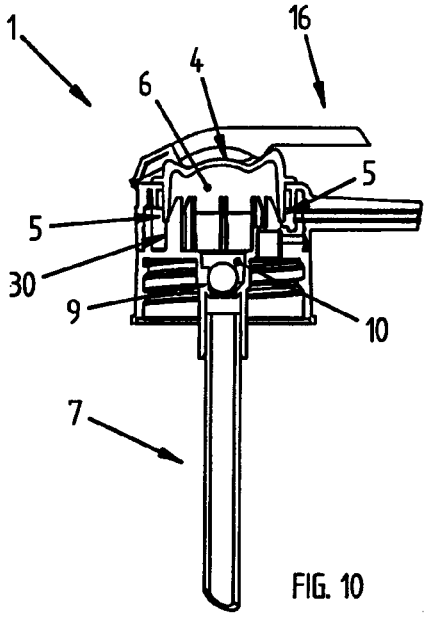

FIG. 10 shows the lever 16 in its first release stage. The lower annular edge 5 of the deformable element 4 returns to rest against the outside of the truncated cone-shaped ends of the ribs 30 of the first cylindrical portion 20 and therefore the chamber 6 is sealed from the outside.

At the same time the ball 9, due to the effect of decompression in the chamber 6, is drawn upwards inside the housing portion 10, opening the suction pipe 7 at the top.

The deformable element 4 is automatically decompressed thanks to its intrinsic characteristics of elastic compliance, and the fluid L is drawn from the inside of the container C along the suction duct 7 and into the chamber 6.

Figure 11:
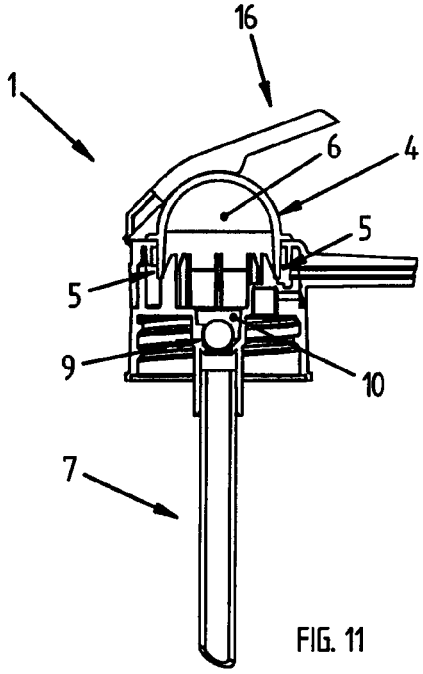
Figure 12:
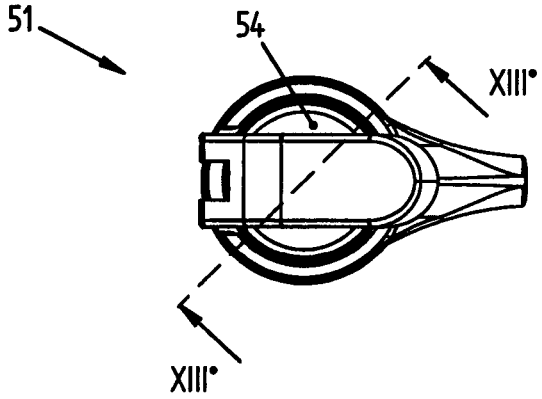
FIG. 12 shows a plan view of a first variant embodiment of the device carried out according to the invention.
Figure 13:
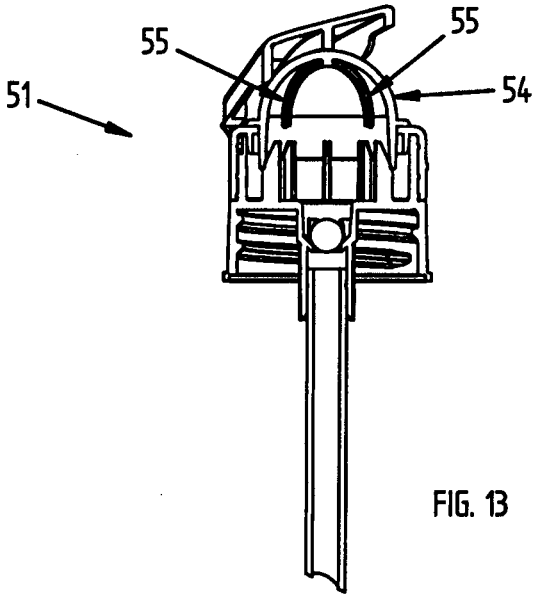
FIG. 13 shows a sectional view of FIG. 12 along line XIII-XIII.
Figure 14:
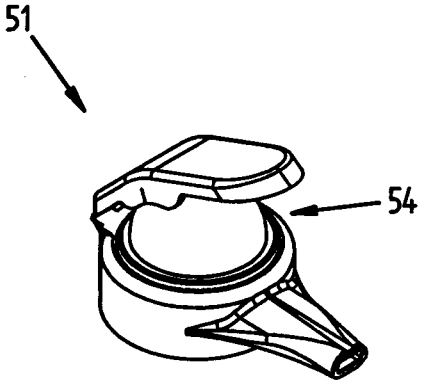
FIG. 14 shows an axonometric view of some parts of the device shown in FIG. 12.
Figure 15:
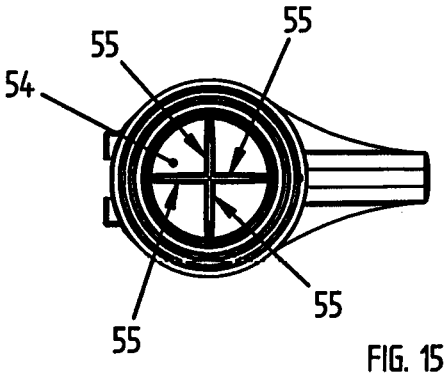
FIG. 15 shows a view from below of the device shown in FIG. 14.

FIG. 11 shows the final stage in which the lever 16 is released and in which the ball 9 is still positioned so as to open the suction pipe 7 and the volume of the chamber 6 has been completely restored.

Once the release of the operating lever 16 has been completed, the ball 9 is arranged again so as to obstruct the suction pipe 7 and the device 1 returns to its initial condition, meaning the condition shown in FIG. 7, with the chamber 6 filled with a measured quantity of fluid L suited to be used for the successive dispensing operation.

The description provided above shows that the presence of the operating lever 16 ensures easy compression of the deformable element 4 and thus of the volume of the chamber 6.

In particular, the deformation of the deformable element 4 always takes place substantially with the same operating modes, that is, with the ribs 22 always working substantially in the same position on the external upper surface 17 of the deformable element 4. This makes it possible to make the area of the external upper surface 17 of the deformable element 4 that is subjected to wear with a suitable material and suitable mechanical characteristics, preferably wear-resistance characteristics.

As already explained, furthermore, the presence of the operating lever 16 makes it possible to dispense a predetermined fixed quantity of fluid L from the device 1 when the device is operated. Said predetermined fixed quantity can then be adjusted during production of the device 1, adjusting the lever stroke by positioning its end properly.

Alternatively, it is possible to provide the dispensing device 1 with means for adjusting the end of stroke that can be operated by the user to directly adjust the doses to be dispensed as desired. For example, the ribs 22 may be created on an additional component that moves as a slide under the lever 16, said ribs 22 being the end-of-stroke elements for the lever 16 itself.

Furthermore, the presence of the operating lever 16 makes it possible to reduce the force necessary for the compression of the deformable element 4 compared to the situation in which the device is operated by the user through the direct action of his/her finger on the deformable element 4, as it occurs in the known art.

In this regard, the longer is the operating lever 16 the lesser is the force necessary to compress the deformable element 4. Said lever 16 will therefore be as long as possible, compatibly with the size and appearance needs of the device 1.

With reference to the figures from 12 to 15, a variant embodiment of the device of the invention is illustrated which differs from the first embodiment described with reference to the figures from 1 to 11 only in that the deformable element 54 has on its inner surface a plurality of projecting ribs 55, four in the case at hand, which give the deformable element 54 more mechanical rigidity and better deformability during operation of the operating lever 16.

Advantageously, the duration of the deformable element 54, and thus of the device 51, is higher.

In variant embodiments the shape, arrangement and number of said projecting ribs may be different.

Figure 16:
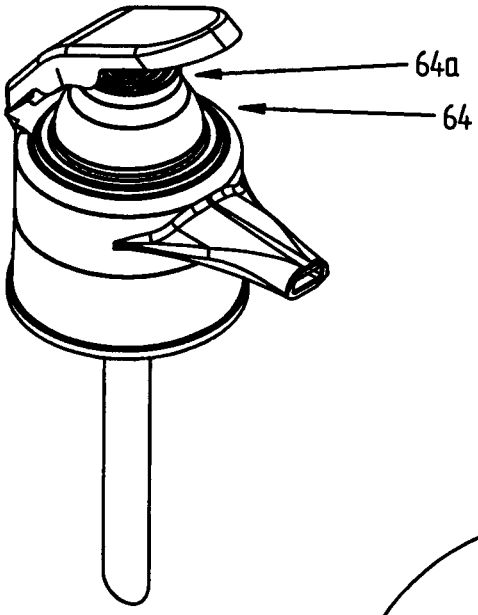
FIG. 16 shows an axonometric view of a further variant embodiment of the device carried out according to the invention.
Figure 17A:
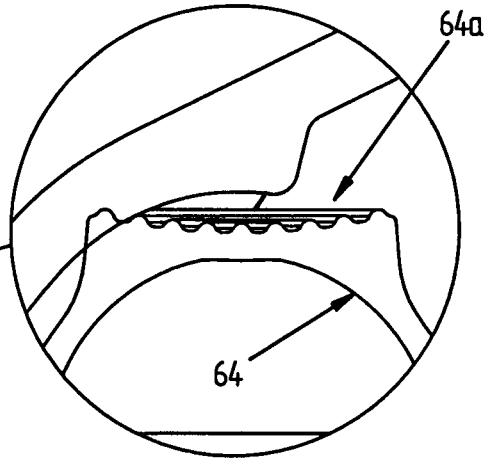
FIG. 17A shows an enlarged detail of FIG. 17.
Figure 17:
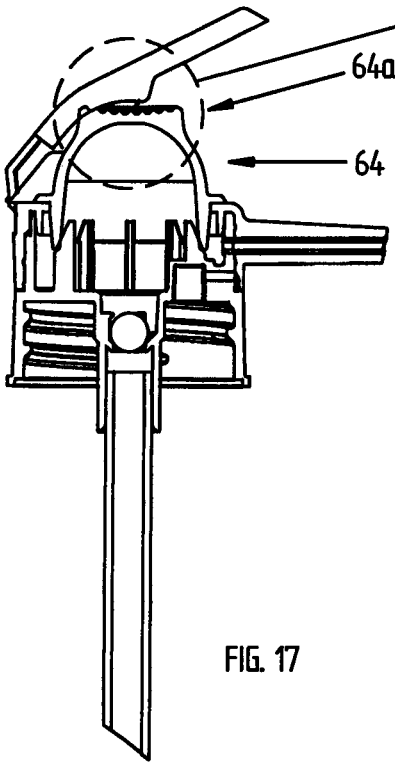
FIG. 17 shows a view of a longitudinal cross section of the device shown in FIG. 16.

With reference to the FIGS. 16 and 17, a further variant embodiment of the invention is illustrated which differs from the first embodiment previously described in that the upper portion 64*a* of the deformable element 64 has a substantially plane area provided with corrugations obtained with projecting concentric circular portions.

Said corrugations give said upper portion 64*a* higher mechanical hardness and higher elastic return.

In the embodiments of the present invention described above the deformable element is elastically yielding and its return to its rest position after compression takes place automatically thanks to its intrinsic characteristics of elastic compliance.

However, in variant embodiments said deformable element may be carried out differently, for example it may be an elastically yielding bellows element.

Alternatively, the stage of return to the rest position may be obtained through auxiliary elastic return means, for example helical springs.

Again, the operating lever may consist of several portions hinged to one another which during operation modify their mutual position in order to advantageously adapt to the profile of the external surface of the deformable element being compressed.

It has thus been shown that the present invention allows all the set objects to be achieved. In particular, it makes it possible to provide a device for dispensing a fluid that allows the quantity of fluid that is dispensed to be controlled every time the device is operated.

While the present invention has been described with reference to the particular embodiments shown in the figures, it should be noted that the present invention is not limited to the specific embodiments illustrated and described herein; on the contrary, further variants of the embodiments described herein fall within the scope of the present invention, which is defined in the claims.

The invention claimed is:

1. Device for dispensing a fluid, said device comprising:

a supporting structure having a top part and a bottom part coupled to the top part provided with means, formed on the bottom part, for coupling to a container containing said fluid, a collapsible chamber defined by a deformable member associated with the top part of said supporting structure and suited to draw and contain a measured quantity of said fluid, an outlet nozzle extending in a direction from a side wall of the top part of said supporting structure and comprising a duct communicating with said collapsible chamber for dispensing the fluid, and a second order lever reciprocally pivoted around a fulcrum on said supporting structure opposite said outlet nozzle, said second order lever moving between a rest position and an operating position in which said second order lever exerts a thrusting action against said deformable member and deforms said collapsible chamber in order to dispense at least one portion of said measured quantity through said duct of said outlet nozzle, said second order lever extending over and away from the side wall of the top part and extending in the direction of said outlet nozzle and having a distal end located entirely above and on one side of and extending directly over said outlet nozzle, whereby when said second order lever is pivoted from the rest position to the operating position said second order lever is pivoted downward towards said outlet nozzle and said second order lever is capable of being made longer so as to require less force to compress said collapsible chamber.

2. The Device according to claim 1, wherein, said second order lever is carried out in a single piece with said supporting structure.

3. The Device according to claim 1, further comprising:

positioning means suited to define said operating position of said second order lever in order to allow deformation of said collapsible chamber and said rest position of said second order lever.

4. The Device according to claim 3, wherein, said positioning means comprises an elastic fulcrum of said second order lever.

5. The Device according to claim 4, wherein, said elastic fulcrum, the top part and said second order lever are carried out in a single piece.

6. The Device according to claim 1, wherein:

said deformable member comprises an elastically yielding ball portion associated with said supporting structure.

7. The Device according to claim 1, wherein, said collapsible chamber communicates with said container through a suction duct.

8. The Device according to claim 7, further comprising:

valve suction means suited to regulate a flow of said fluid from said suction duct into said collapsible chamber.

9. The Device according to claim 1, further comprising:

valve dispensing means suited to regulate delivery of said fluid from said collapsible chamber to said duct.

10. The Device according to claim 1, wherein, said coupling means allow said device to be removably coupled to said container.

11. System for dispensing a fluid, comprising a container for said fluid and a device for dispensing said fluid, wherein said device for dispensing the fluid is constructed according to claim 1.

12. The Device for dispensing the fluid as in claim 1 further comprising:

an annular chamber formed in the bottom part of said supporting structure communicating with a lower annular edge of the deformable member; and a duct coupling said outlet nozzle to said annular chamber, whereby when said second order lever is moved, the deformable member is deformed and the fluid flows through said annular chamber and is dispensed from said outlet nozzle.

13. Device for dispensing a fluid, said device comprising:

a supporting structure having a top part and a bottom part coupled to the top part provided with means, formed on the bottom part, for coupling to a container containing said fluid, a collapsible chamber defined by a deformable member associated with the top part of said supporting structure and suited to draw and contain a measured quantity of said fluid, an outlet nozzle extending in a direction from a side wall of the top part of said supporting structure and comprising a duct communicating with said collapsible chamber for dispensing the fluid, a second order lever reciprocally pivoted around a fulcrum on said supporting structure opposite said outlet nozzle, said second order lever moving between a rest position and an operating position in which said second order lever exerts a thrusting action against said deformable member and deforms said collapsible chamber in order to dispense at least one portion of said measured quantity through said duct of said outlet nozzle, said second order lever extending over and away from the side wall of the top part and extending in the direction of said outlet nozzle and having a distal end located entirely above and on one side of and extending directly over said outlet nozzle, and, wherein said second order lever comprise a shaped area matching a substantial portion of a shape of an area of said deformable member with which they come into contact, whereby when said second order lever is pivoted from the rest position to the operating position said second order lever is pivoted downward towards said outlet nozzle and said second order lever is capable of being made longer so as to require less force to compress said collapsible chamber.

14. A device for dispensing a fluid comprising:

a top part;

a bottom part attaching to said top part;

a cylindrical portion, positioned within said bottom part, having ribs with truncated cone shaped ends extending therefrom towards said top part;

an annular chamber encircling said cylindrical portion;

an outlet nozzle extending from a side wall of said top part, said outlet nozzle having a duct coupled to said annular chamber;

a deformable element having a chamber therein and a lower annular edge placed within and extending from said top part, the lower annular edge placed over the ribs and around said cylindrical portion, whereby when said deformable element is deformed increased pressure is created in the chamber and the lower annular edge is deformed creating an opening towards said annular chamber;

an operating lever movably attached to said top part forming a fulcrum opposite said outlet nozzle and extending over said deformable element and entirely above and directly over said outlet nozzle, whereby said deformable element is compressed by movement of said operating lever downward towards said outlet nozzle and said operating lever is capable of being made longer so as to require less force to compress said deformable element;

a suction pipe attached to said bottom part and communicating with the chamber of said deformable element; and a valve placed between said suction pipe and the chamber of said deformable element, whereby when said operating lever is moved, said deformable element is deformed and a fluid is dispensed from said outlet nozzle.

15. The device for dispensing the fluid as in claim 14 wherein:

said operating lever is a second order lever.

16. The device for dispensing the fluid as in claim 14 wherein:

an external surface of said operating lever matches a shape of said deformable element.

* * * * *